US009016794B2

(12) United States Patent
Ogg

(10) Patent No.: US 9,016,794 B2
(45) Date of Patent: Apr. 28, 2015

(54) MODULAR CHAIR AND METHOD OF ASSEMBLY

(71) Applicant: Ogg Design, Inc., Littlestown, PA (US)

(72) Inventor: Richard K. Ogg, Littlestown, PA (US)

(73) Assignee: Ogg Design, Inc., Littlestown, PA (US)

( * ) Notice: Subject to any disclaimer, the term of this patent is extended or adjusted under 35 U.S.C. 154(b) by 0 days.

(21) Appl. No.: 14/079,680

(22) Filed: Nov. 14, 2013

(65) Prior Publication Data

US 2014/0139000 A1 May 22, 2014

Related U.S. Application Data

(60) Provisional application No. 61/728,455, filed on Nov. 20, 2012.

(51) Int. Cl.

| | |
|---|---|
| ***A47C 4/02*** | (2006.01) |
| ***A47C 13/00*** | (2006.01) |
| ***A47C 1/124*** | (2006.01) |
| ***A47C 7/54*** | (2006.01) |

(52) U.S. Cl.

CPC ..... *A47C 4/021* (2013.01); *A47C 13/005* (2013.01); *Y10T 29/49959* (2015.01); *A47C 1/124* (2013.01); *A47C 7/546* (2013.01)

(58) Field of Classification Search

CPC ..... A47C 4/02
USPC ..... 297/440.13–440.16
See application file for complete search history.

(56) References Cited

U.S. PATENT DOCUMENTS

| | | | | | |
|---|---|---|---|---|---|
| 3,301,597 | A | * | 1/1967 | Bereday | 297/450.1 |
| 3,632,150 | A | * | 1/1972 | Milakovich | 297/440.22 |
| 4,140,065 | A | * | 2/1979 | Chacon | 297/440.15 |
| 4,395,071 | A | | 7/1983 | Laird | |
| 4,492,409 | A | | 1/1985 | Laird | |
| 4,844,541 | A | | 7/1989 | Laird | |
| 5,000,512 | A | | 3/1991 | Laird | |
| 5,803,548 | A | * | 9/1998 | Battle | 297/440.13 |
| 5,890,767 | A | * | 4/1999 | Chang | 297/440.14 |
| 6,145,929 | A | * | 11/2000 | Gollahon | 297/344.1 |
| 6,189,974 | B1 | * | 2/2001 | Beck | 297/440.13 |
| 6,422,654 | B1 | * | 7/2002 | Grove | 297/440.16 |
| 7,134,728 | B1 | * | 11/2006 | Buhrman | 297/440.14 |
| 7,300,110 | B1 | * | 11/2007 | Debien | 297/440.13 |

* cited by examiner

*Primary Examiner* — Peter Brown
(74) *Attorney, Agent, or Firm* — William C. Schrot; Jeffrev I. Auerbach; AuerbachSchrot LLC

(57) ABSTRACT

A modular chair includes a lower support portion, a seat portion, and a back portion. The seat portion includes a front area having a retaining member which cooperates with a corresponding cross bar on the lower support portion, and a rear area including one or more slots therein. The back portion includes one or more protrusions, which are received in the slots of the seat portion, so that the seat portion is secured between the cross bar of the lower support portion via the retaining member and the protrusions of the back portion. The back portion is secured to the lower support portion via a latch mechanism accessible to a user.

19 Claims, 19 Drawing Sheets

MODULAR CHAIR AND METHOD OF ASSEMBLY

CROSS REFERENCE TO RELATED APPLICATION AND CLAIM TO PRIORITY

This application is based on U.S. provisional application Ser. No. 61/728,455, filed Nov. 20, 2012, entitled "Modular Chair and Method of Assembly," which application is incorporated herein by reference in its entirety and to which priority is claimed.

FIELD OF THE INVENTION

The present invention relates to modular furniture and in particular a modular chair and a method of assembling and disassembling the chair.

BACKGROUND OF THE INVENTION

Conventional chairs and couches, and in particular upholstered chairs and couches, are relatively expensive to fabricate. Such conventional furniture typically includes a relatively bulky frame including springs or padding, which is covered with fabric. Fabric covered cushions are then placed on the covered frame. If damaged or worn out, such conventional furniture pieces are difficult to repair or re-upholster. Moreover, such furniture is relatively difficult to clean, and therefore has not proven suitable for many business environments, such as in health care offices or university or student settings. As a result, the comfort and aesthetics of the seating in many office and student settings is lacking.

Accordingly, there is a need for a chair that may be easily assembled, disassembled and reconfigured for storage or repair, and to alter the appearance thereof.

SUMMARY OF THE INVENTION

The present invention is directed to a modular chair including a lower support portion, a seat portion, and a back portion. The primary segments of the chair (the lower support portion, the seat portion and the back portion) may be easily and readily de-coupled for storage, transport and/or re-upholstering as desired.

The seat portion includes a front having an engagement or retaining member which cooperates with a corresponding portion or component on the lower support portion, and a rear including one or more slots therein. The back portion includes one or more teeth or protrusions, which are received in the slots of the seat portion, so that the seat portion is secured between the component on the lower support portion (via the engagement or retaining member) and the teeth of the back portion. The back portion is secured to the lower support portion via a latch mechanism. Thus, a single latch mechanism retains the back portion to the lower support portion, which in turn retains the seat portion.

According to one embodiment of the present invention, a modular chair comprises a support portion defining a receiving area, a seat portion, a back portion and a latch mechanism. The seat portion is removably disposable in the receiving area and supported by the support portion. The seat portion includes a slot. The back portion includes an outwardly extending protrusion, which is receivable in the slot. The latch mechanism is coupled to the support portion and actuatable between a locked position retaining the back portion against the support portion, and an unlocked position permitting the back portion from being decoupled from the support portion.

When the seat portion is disposed in the receiving area, the protrusion is extendable through the slot so that the seat portion is retained within the receiving area when the latch mechanism is in its locked position.

In one embodiment, the seat portion further comprises a retaining member engageable with a correspondingly configured component of the support portion when the seat portion is disposed in the receiving area.

In one embodiment, the support portion includes a plurality of cross bars defining a generally rectangular or square configuration in plan view. The receiving area is disposed between or defined by the plurality of cross bars. In one implementation, the plurality of cross bars includes a rear cross bar and an auxiliary cross bar spaced from and substantially parallel to the rear cross bar. The protrusion is disposed between the rear and auxiliary cross bars when the back portion is retained against the support portion.

In one embodiment, the back portion further comprises an outwardly extending flange portion, which includes a first alignment member. The support portion further comprises an upwardly extending brace, which includes a second alignment member engageable with the first alignment member when the back portion is retained against the support portion.

In one embodiment, the back portion further comprises at least one bracket member, and the latch mechanism includes a catch configured to releasably engage the bracket member when the back portion is retained against the support portion, thereby retaining the back portion to the support portion. In one implementation, the catch is configured as first and second rods. Each of the rods has a first end pivotally coupled to a plate and a second distal end receivable in an opening in first and second bracket members when the latch mechanism is in its locked position. The latch mechanism is movable between its locked and unlocked positions via rotation of the plate.

In one embodiment, the back portion includes first and second bracket members extending outwardly from a bottom portion thereof. The protrusion extends outwardly from the bottom portion and is disposed between the first and second bracket members.

In one embodiment, the seat portion includes a raised surface disposed on a first plane, and a peripheral edge portion extending around the raised surface and disposed on a second plane spaced from and substantially parallel to the first plane. In one implementation, the slot is disposed in the peripheral edge portion.

The present invention is also directed to a method of assembling a modular chair, comprising the steps of: providing a support portion defining a receiving area; disposing a seat portion in the receiving area, the seat portion including a slot; providing a back portion including an outwardly extending protrusion; moving the protrusion into the slot; and retaining via a latch mechanism the back portion to the support portion when the protrusion is received in the slot, so that the seat portion is retained within the receiving area.

According to another embodiment of the present invention, a modular chair comprises a support portion defining a receiving area, a seat portion removably disposable in the receiving area and supported by the support portion, a back portion including a bottom section removably disposable against the seat portion when the seat portion is disposed in the receiving area, and a latch mechanism coupled to the support portion. The latch mechanism is actuatable between a locked position retaining the back portion to the support portion, and an unlocked position permitting the back portion from being decoupled from the support portion. The seat portion is retained within the receiving area and between the support portion and the back portion when the latch mechanism is in its locked position.

In one embodiment, the back portion comprises a bracket member extending outwardly from a bottom portion thereof. The latch mechanism includes a catch configured to releasably engage the bracket member when the bottom section of the back portion is disposed against the seat portion and the seat portion is disposed in the receiving area.

In one embodiment, the catch is configured as a rod having an end movable into and out of an opening in the bracket member.

In one embodiment, the support portion includes a port, and the latch mechanism is accessible and actuatable through or by the port.

In one embodiment, the back portion further comprises a first alignment member, and the support portion further comprises a second alignment member engageable with the first alignment member when the back portion is retained against the support portion and disposed in a predetermined orientation relative to the support portion.

DETAILED DESCRIPTION OF THE INVENTION

The terms "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Figure 1:
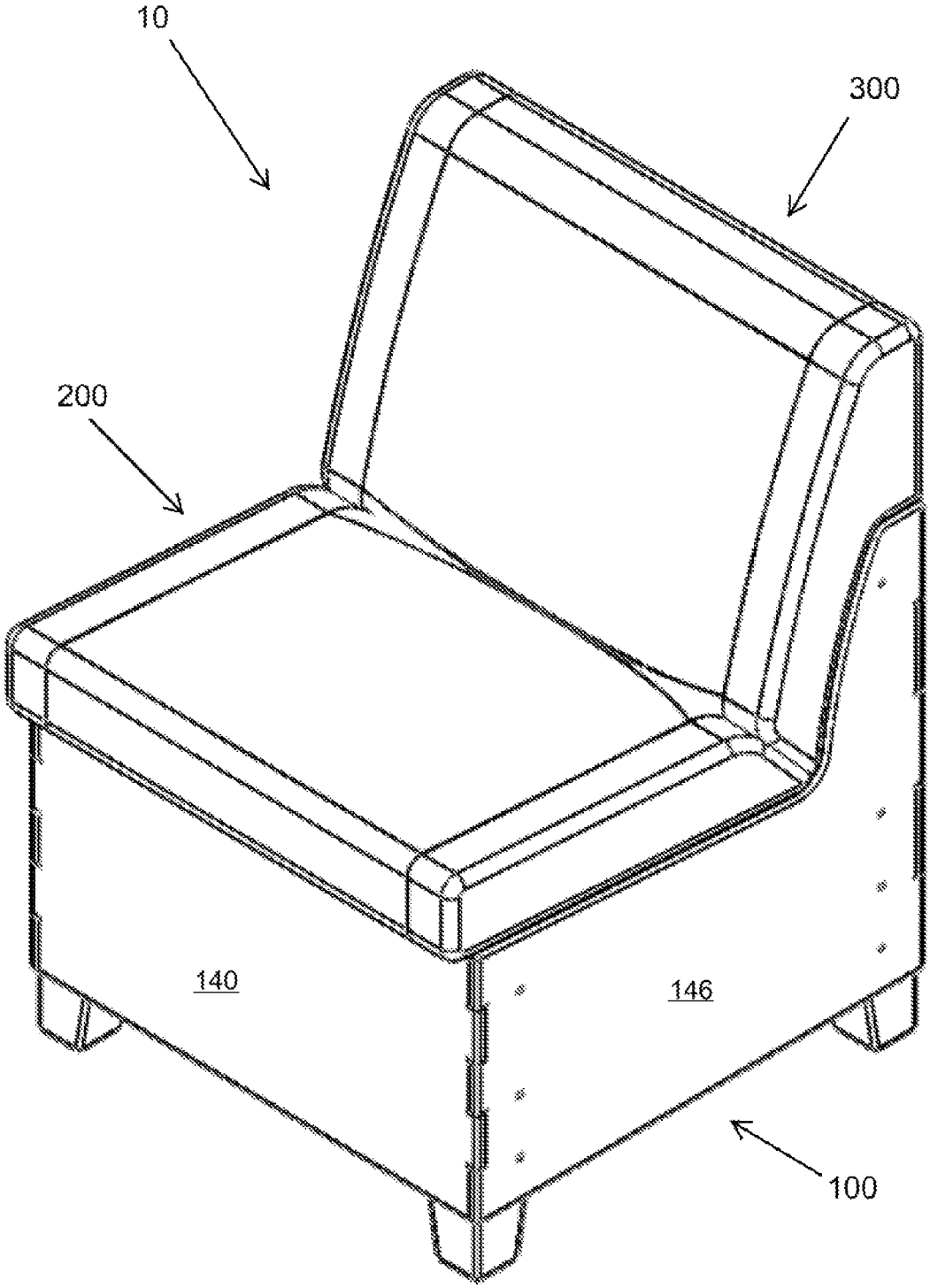
FIG. 1 illustrates a front perspective view of a modular chair according to an embodiment of the present invention.

A modular chair 10 according to an embodiment of the present invention is illustrated in FIG. 1. In one embodiment, the chair 10 includes a lower support portion 100, a seat portion 200, and a back portion 300.

Figure 2:
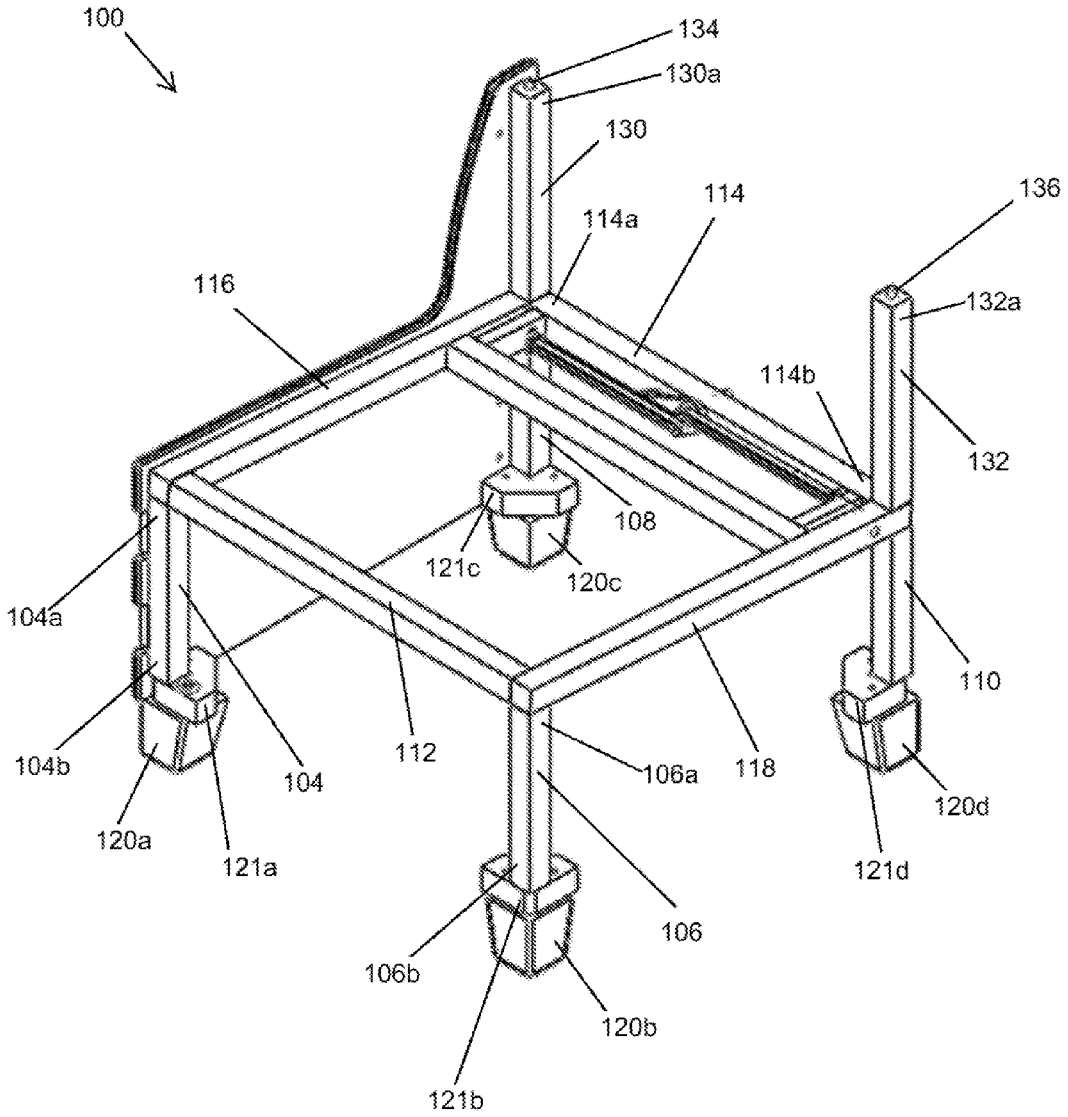
FIG. 2 illustrates a front perspective view of components of the lower support portion of the chair of FIG. 1.
Figure 3:
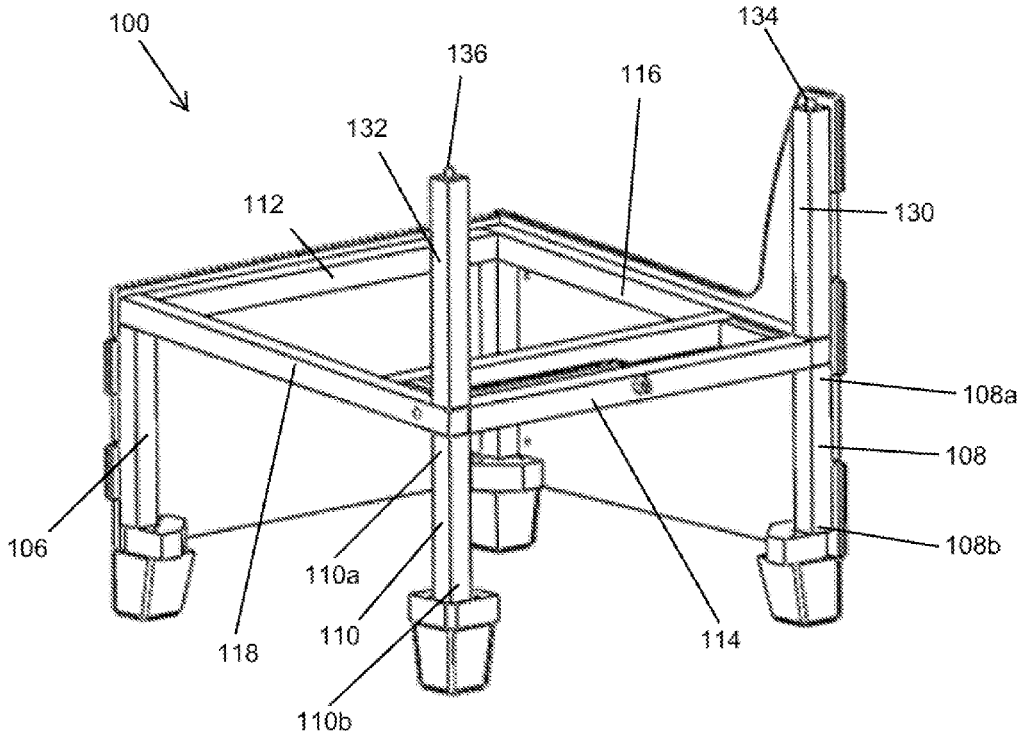
FIG. 3 illustrates a rear perspective view of the components of FIG. 2.

Referring to FIGS. 2 and 3, the lower support portion 100 includes spaced front supports or cleats 104, 106 and spaced rear supports or cleats 108, 110, and a plurality of cross bars 112, 114, 116, 118. A front cross bar 112 extends between and is coupled to upper ends 104*a*, 106*a* of the front cleats 104, 106, and a rear cross bar 114 extends between and is coupled to upper ends 108*a*, 110*a* of the rear cleats 108, 110. The cross bars 112, 114, 116, 118 define a generally rectangular or square configuration in plan view. Legs or feet 120*a*, 120*b*, 120*c*, 120*d* are coupled to lower ends 104*b*, 106*b*, 108*b*, 110*b* of the cleats 104, 106, 108, 110, respectively. The feet 120*a*, 120*b*, 120*c*, 120*d* may have a variable length, such as for providing a lower less formal chair configuration (e.g., such as for a lounge or easy chair) or alternatively for providing a higher more formal chair configuration (e.g., such as for a chair for a table).

In one embodiment, corner blocks 121*a*, 121*b*, 121*c*, 121*d* are disposed between and interconnecting cleats 104, 106, 108, 110 and the corresponding feet 120*a*, 120*b*, 120*c*, 120*d*, respectively. The cleats 104, 106, 108, 110 aid in supporting the load from the seat portion 200 to the corner blocks 121*a*, 121*b*, 121*c*, 121*d* and/or feet 120*a*, 120*b*, 120*c*, 120*d*. The length of the cleats 104, 106, 108, 110 and feet 120*a*, 120*b*, 120*c*, 120*d* collectively define the height of the seat portion 200 of the chair 10, and thus may vary as desired.

Figure 4:
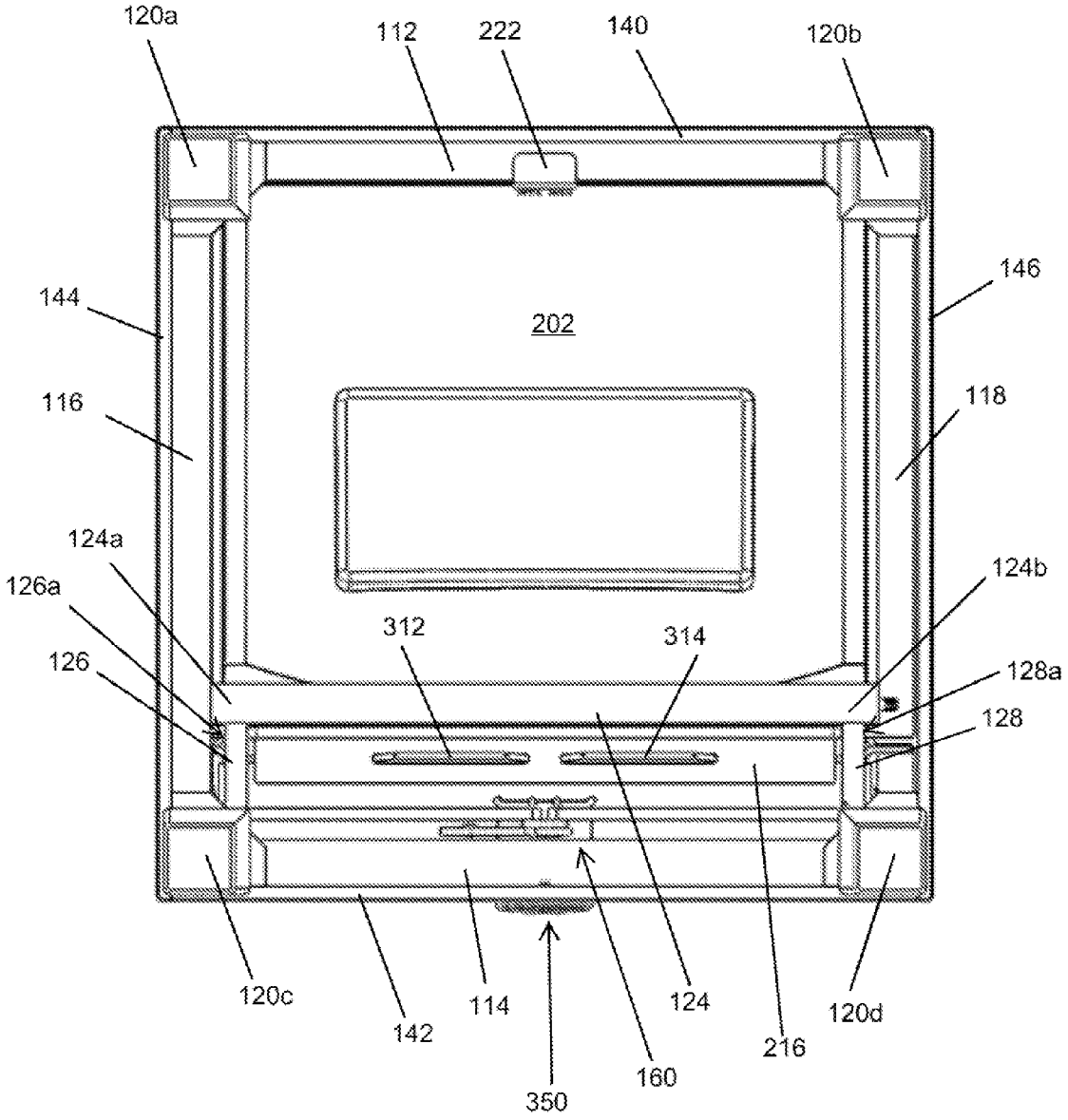
FIG. 4 illustrates a bottom plan view of the chair of FIG. 1.
Figure 5:
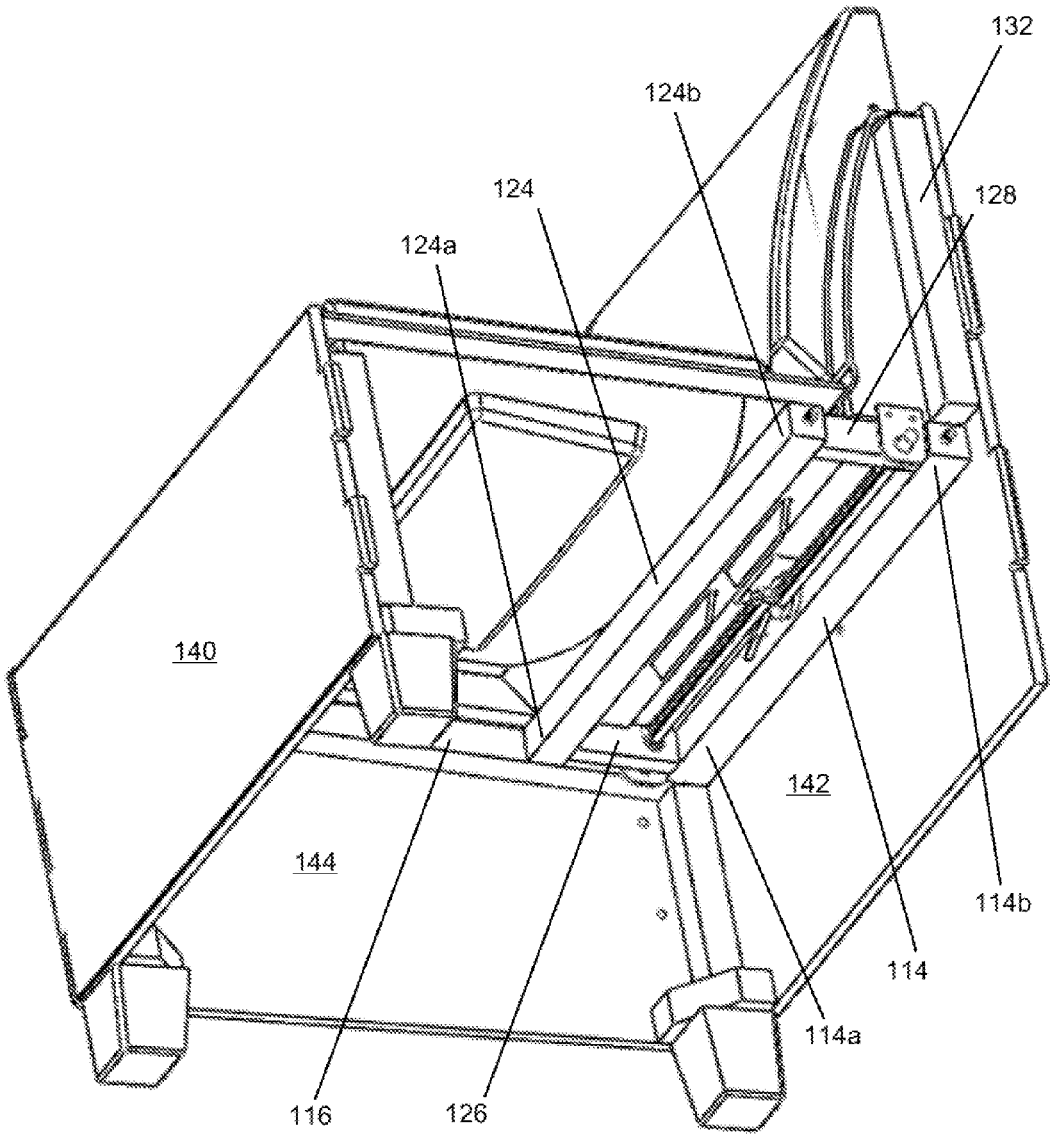
FIG. 5 illustrates a bottom perspective view of components of the chair of FIG. 1.

Referring to FIGS. 4 and 5, an auxiliary cross bar 124 extends between opposing side cross bars 116, 118. The auxiliary cross bar 124 is spaced from and preferably parallel to the rear cross bar 114. In one implementation, a spacer member 126 is coupled to and extends between an end 124*a* of the auxiliary cross bar 124 and a corresponding end 114*a* of the rear cross bar 114, and another spacer member 128 is coupled to and extends between the other end 124*b* of the auxiliary cross bar 124 and the other end 114*b* of the rear cross bar 114.

Referring again to FIGS. 2 and 3, first and second braces 130, 132 are connected to the lower support portion 100, extending upwardly from and adjacent to opposing ends 114*a*, 114*b* of the rear cross bar 114. In one implementation, the braces 130, 132 are axially aligned with the rear cleats 108, 110. Each of the braces 130, 132 includes a guide pin or post 134, 136, respectively, which extend upwardly from a corresponding distal end 130*a*, 132*a* thereof.

Figure 6:
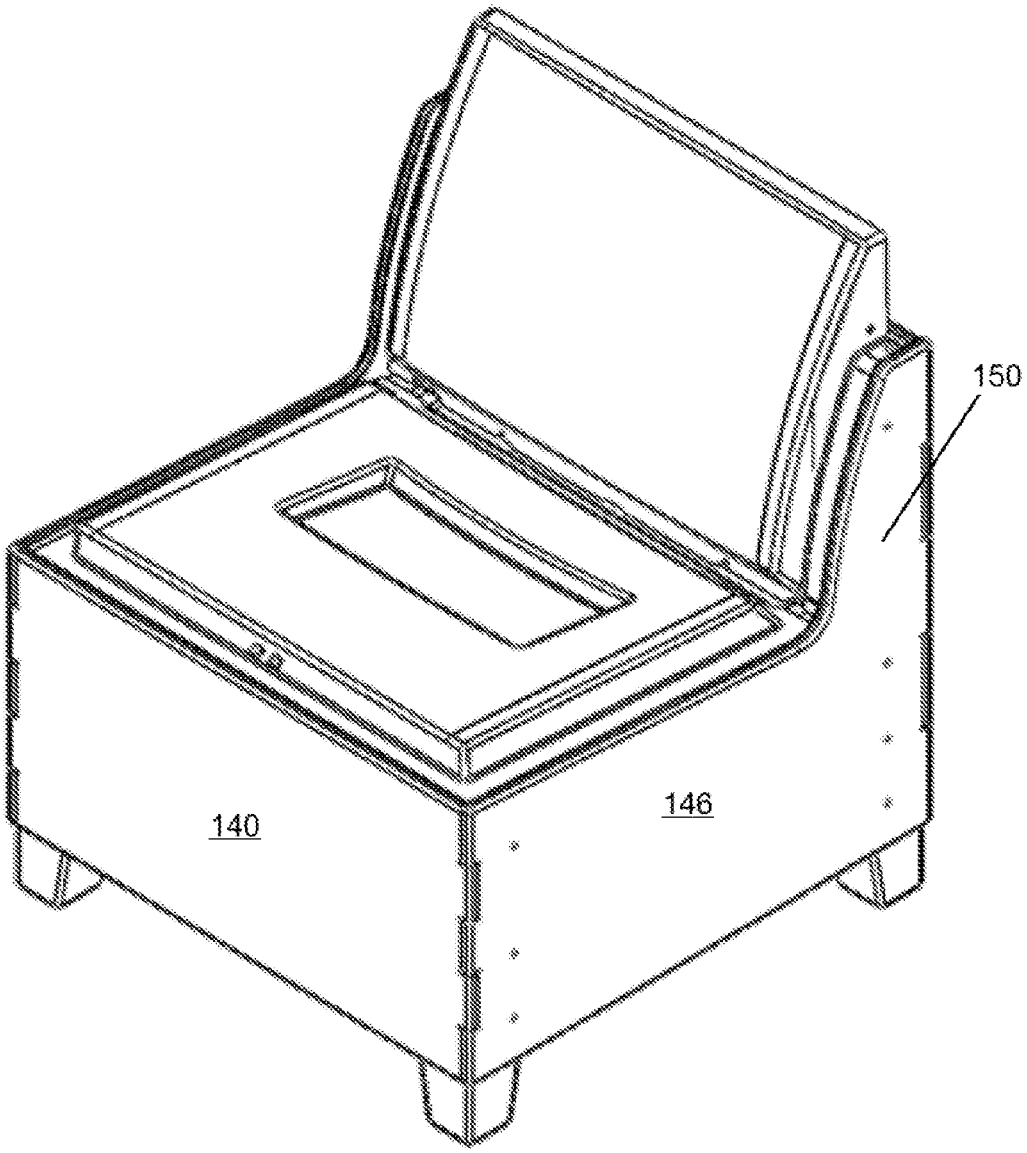
FIG. 6 illustrates a perspective view of the chair of FIG. 1 without coverings on the segments thereof.
Figure 7:
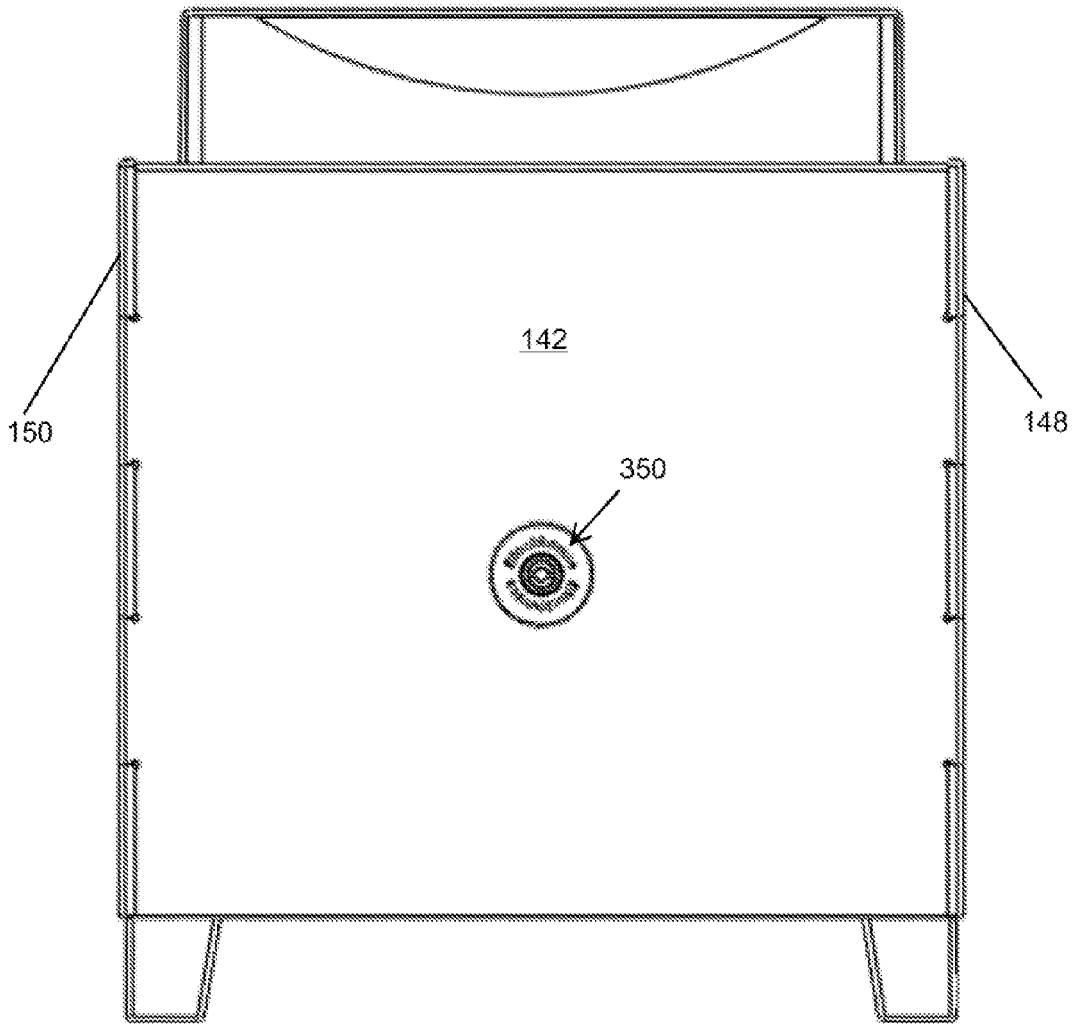
FIG. 7 illustrates a back elevational view of the chair of FIG. 1.

With reference to FIGS. 4, 5 and 6, panels 140, 142, 144, 146 extend between and are coupled to adjacent cleats 104, 106, 108, 110 and the corresponding cross bars 112, 114, 116, 118. A front panel 140 extends between and is coupled to opposing front cleats 104, 106, and a rear panel 142 extends between and is coupled to opposing rear cleats 108, 110. A side panel 144 extends between and is coupled to adjacent front and rear cleats 104, 108, and another side panel 146 extends between and is coupled to the other adjacent front and rear cleats 106, 110. As shown in FIG. 6, in one embodiment, the side panels 144, 146 include upwardly extending portions 148, 150, respectively, each of which are secured to a corresponding one of the braces 130, 132, thereby providing additional support to the braces 130, 132. As shown in FIG. 7, the rear panel 142 may have a height which aligns with the height and edges of the upwardly extending portions 148, 150. The panels 140, 142, 144, 146 may include dovetailed joints on their ends thereof, which interconnect to securely and rigidly surround the lower support portion 100, as best shown in FIGS. 6 and 7.

Figure 8:
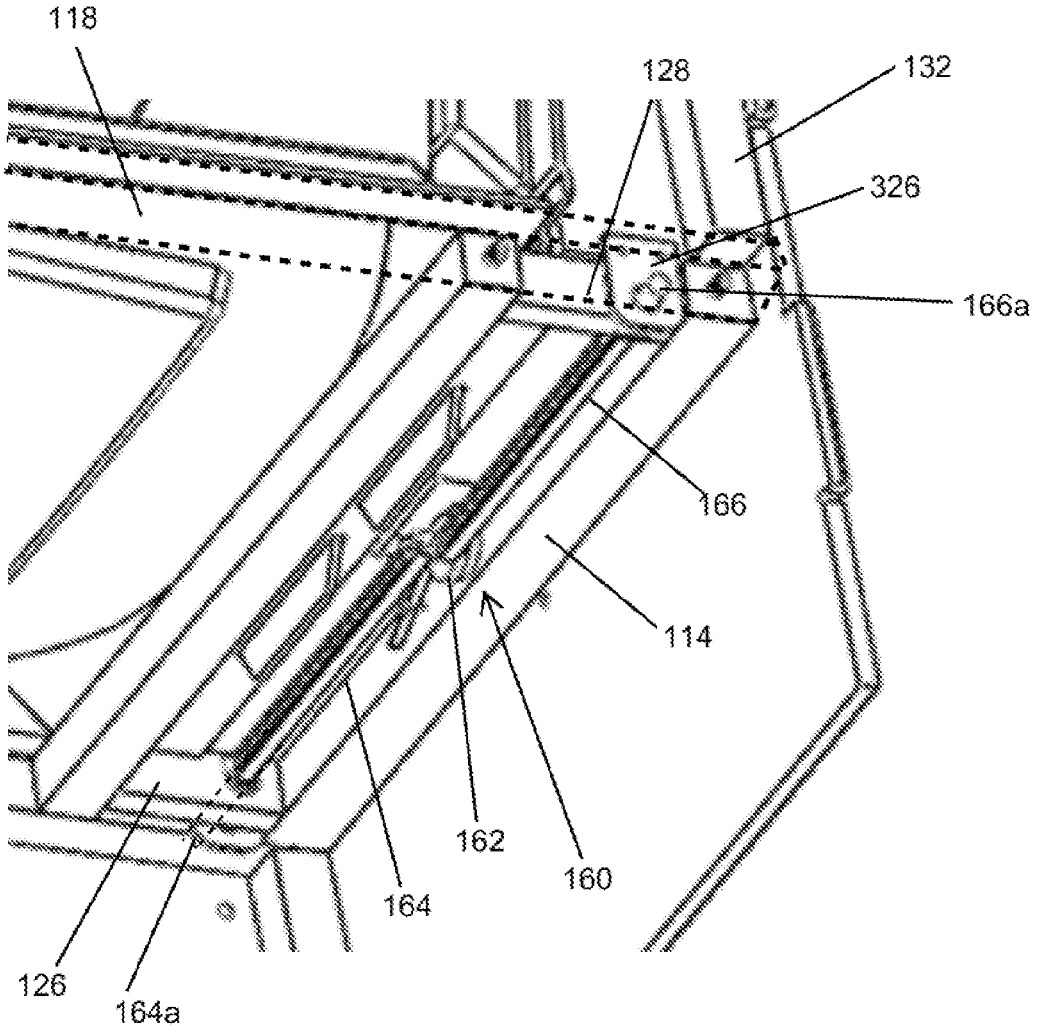
FIG. 8 illustrates a fragmentary perspective view of components of the chair of FIG. 1, showing the latch mechanism.

Referring to FIGS. 4 and 8, a latch mechanism 160 is coupled to the rear cross bar 114. In one embodiment, the latch mechanism 160 includes a plate 162 pivotally disposed relative to the rear cross bar 114. A first rod 164 is rotatably coupled to the plate 162, and extends outwardly therefrom and through or toward a correspondingly configured opening in the spacer member 126. A second rod 166 is rotatably coupled to the plate 162, and extends outwardly therefrom and through or toward a correspondingly configured opening in the other spacer member 128. The first and second rods 164, 166 are offset from each other on the plate 162, so that upon rotation of the plate 162, distal ends 164*a* (shown in phantom), 166*a* of the first and second rods 164, 166, respectively, move outwardly and protrude from the corresponding spacer members 126, 128.

Thus, the distal ends 164*a*, 166*a* of the rods 164, 166 may be moved between an unlocked position substantially flush with or recessed from outer surfaces 126*a*, 128*a* of the spacer members 126, 128, and a locked position extending outwardly and protruding from the outer surfaces 126*a*, 128*a* of the spacer members 126, 128. The latch mechanism 160 is configured to engage cooperating components on the back portion 300, as discussed in further detail below.

Figure 9:
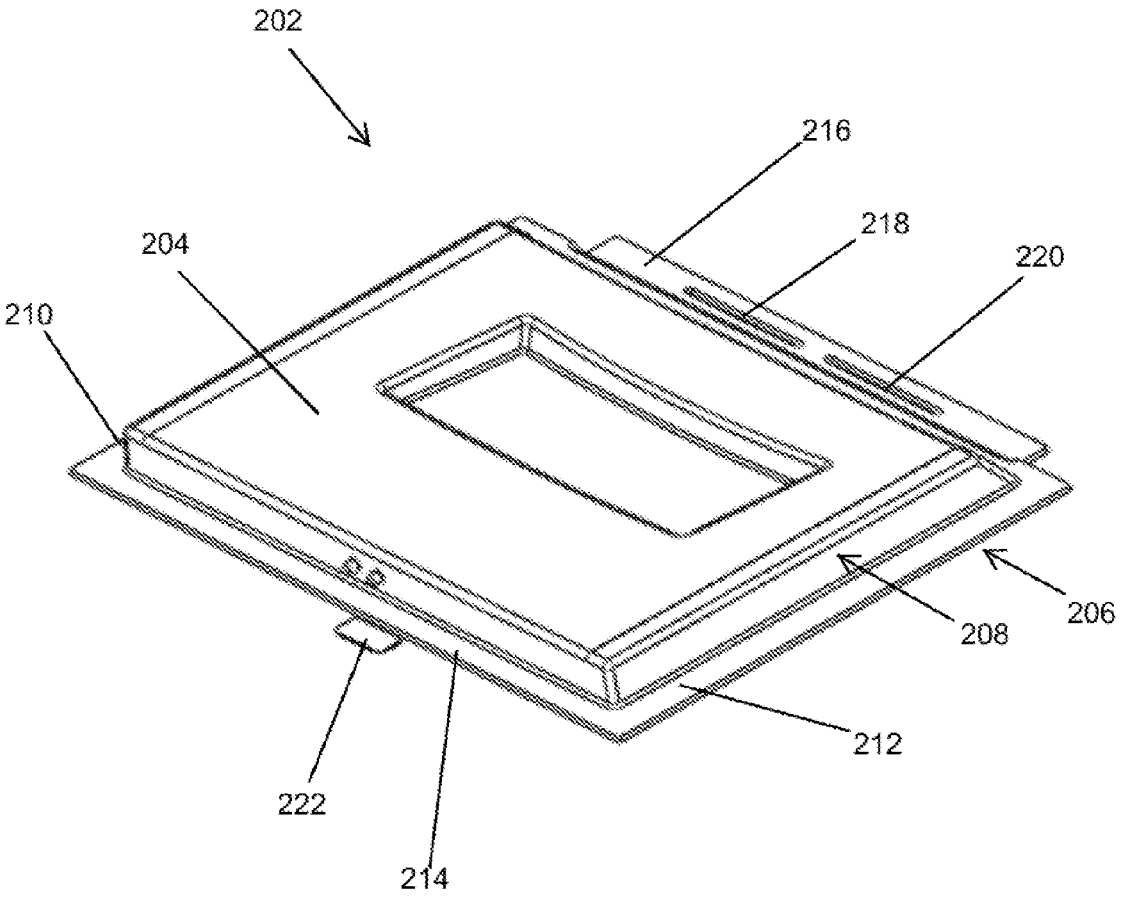
FIG. 9 illustrates a top perspective view of a tray of the seat portion of the chair of FIG. 1.
Figure 10:
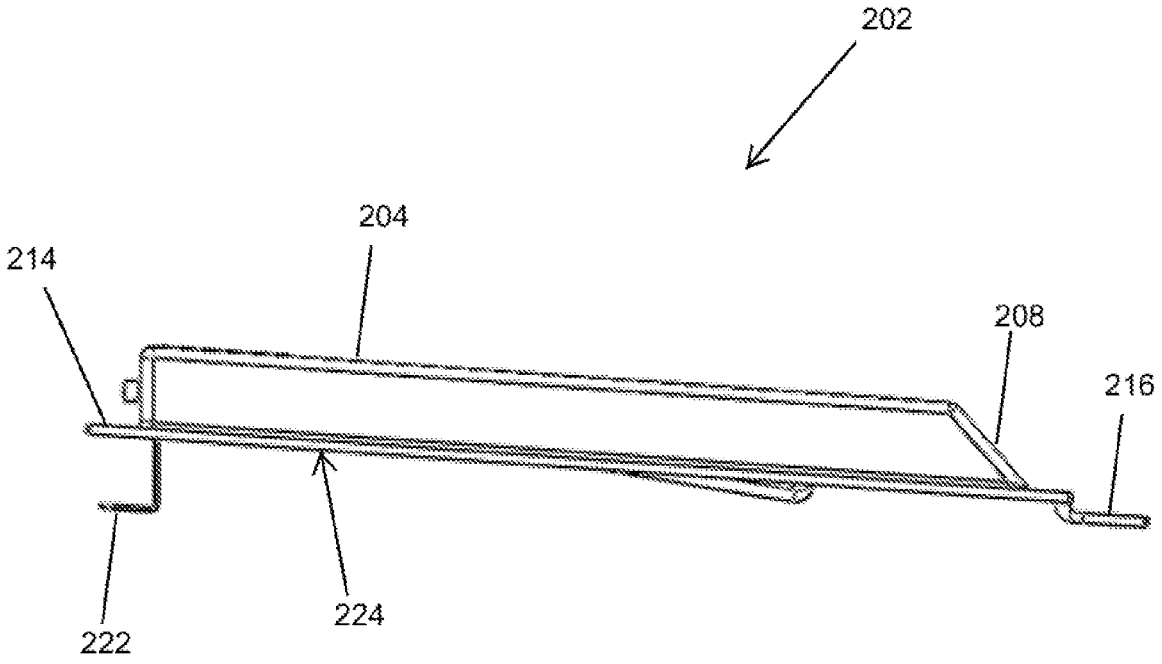
FIG. 10 illustrates a side elevational view of the seat portion of FIG. 9.

Referring to FIGS. 9 and 10, the seat portion 200 includes a tray 202 having a raised surface 204 suitably sized and configured to receive cushioning material (e.g., such as foam). A peripheral edge portion 206 extends about the raised surface 204. In one implementation, the edge portion 206 is disposed on a plane spaced from the plane on which raised surface 204 is disposed, with an angled interface portion 208 extending between and interconnecting the raised surface 204 and the edge portion 206. The edge portion 206 includes opposing side areas 210, 212 which rest against the opposing side cross bars 116, 118, as shown in FIG. 4. The edge portion 206 further includes a front area 214 which aligns with and is disposed against the front cross bar 112, and a back area 216 which aligns with and is disposed against (and extends beyond) the auxiliary cross bar 124. A retaining member 222 is coupled to and extends outwardly from an undersurface 224 beneath the front area 214 of the tray 202, such as shown in FIG. 10.

The front cross bar 112 is engaged by the retaining member 222, so that the front cross bar 112 is disposed between the front area 214 of the edge portion 206 and the retaining member 222, as shown in FIG. 4. Referring again to FIG. 9, the back area 216 of the edge portion 206 includes one or more openings or slots 218, 220, which are configured to receive cooperating components on the back portion 300, as discussed in further detail below.

Figure 11:
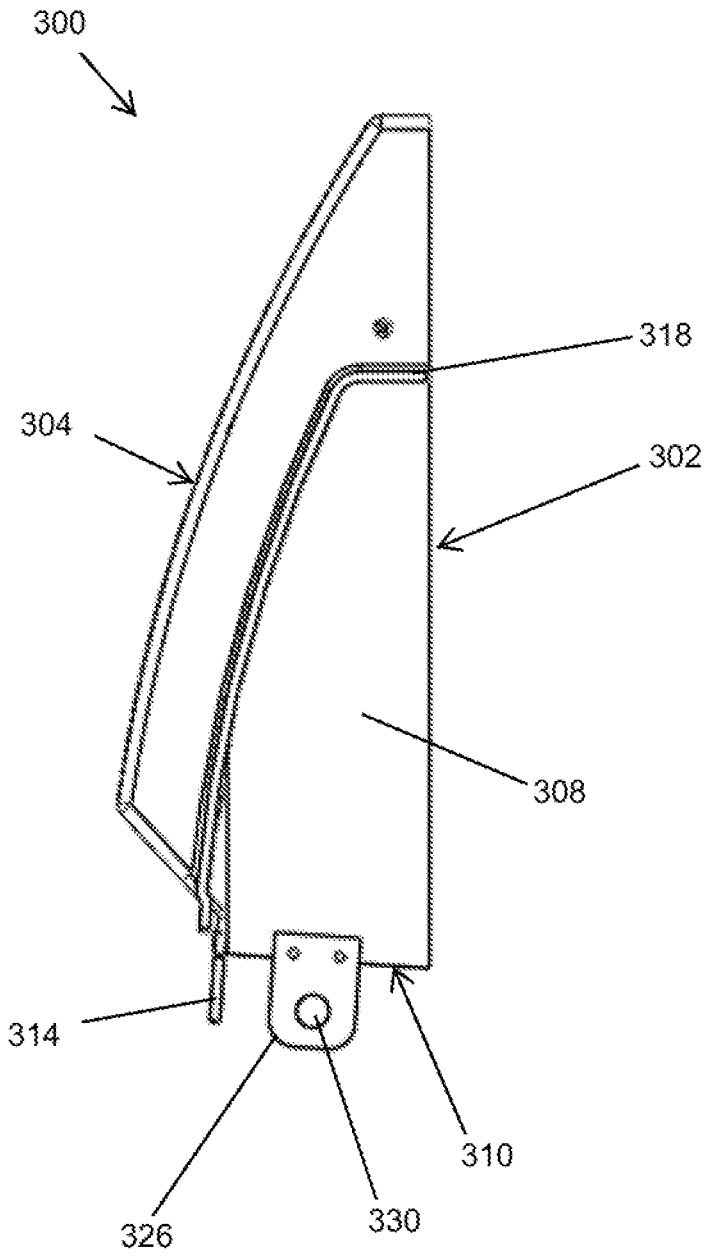
FIG. 11 illustrates a side elevational view of a back portion of the chair of FIG. 1.
Figure 12:
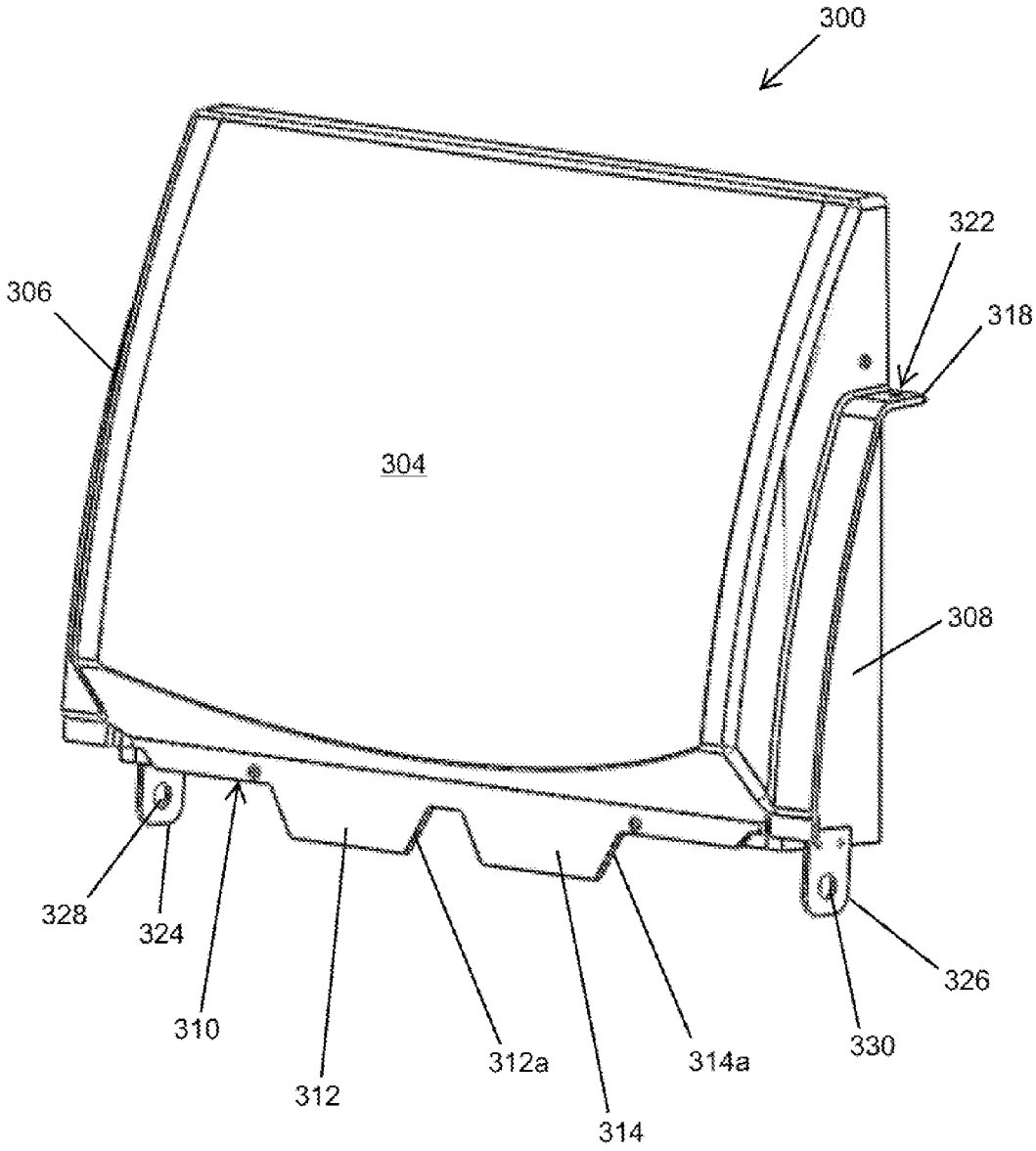
FIG. 12 illustrates a front perspective view of the back portion of FIG. 11.
Figure 13:
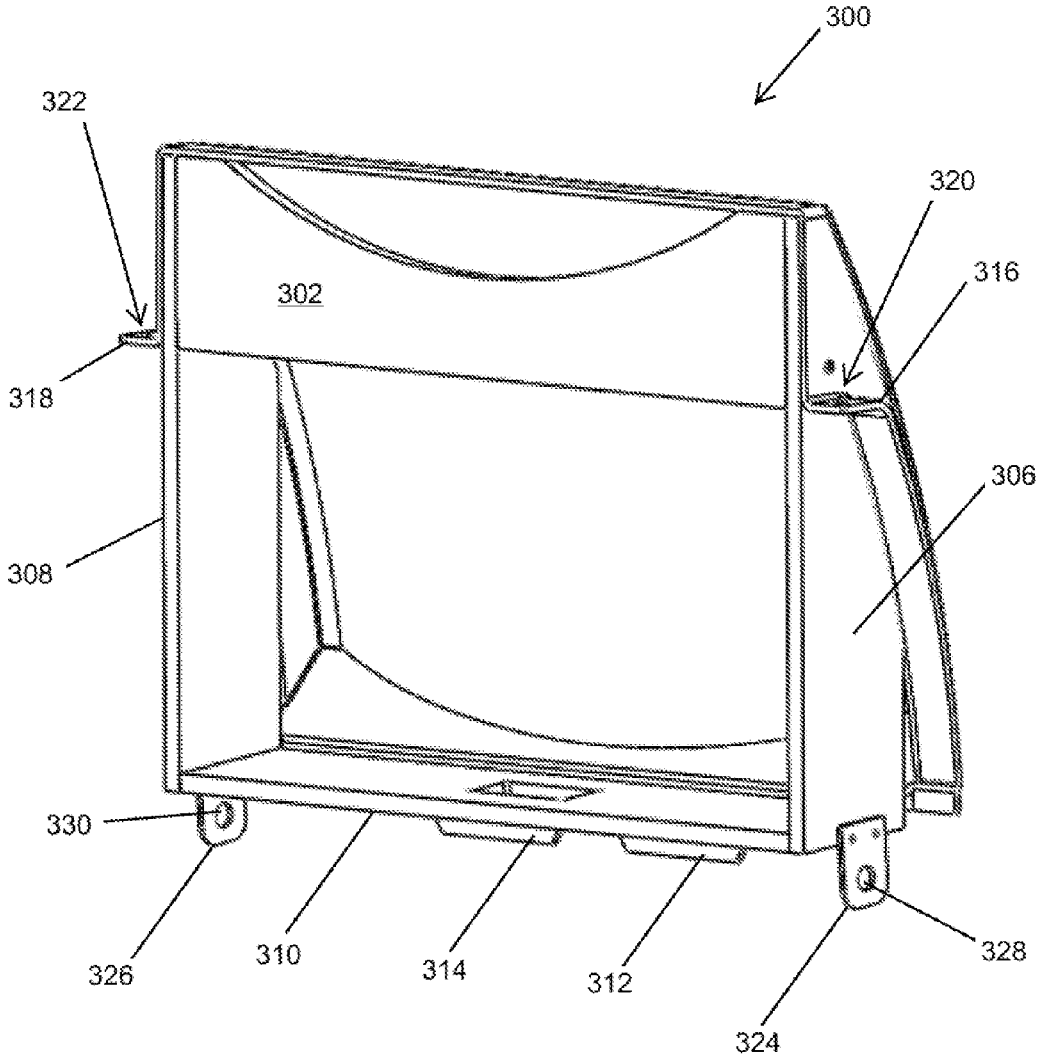
FIG. 13 illustrates a rear perspective view of the back portion of FIG. 11.

Referring to FIGS. 11, 12 and 13, the back portion 300 includes a back side 302, a front side 304, and opposite right and left sides 306, 308. The back side 302 may be substantially planar and/or define the exteriorly disposed surface of the back portion 300 of the chair 10. The front side 304 may have a curved configuration defining the interiorly disposed surface of the back portion 300 against which a user's back is supported. Accordingly, the front side 304 is preferably appropriately configured to provide adequate comfort and lumbar support to the user when sitting in the chair 10. Alternatively or in addition, cushioning material (e.g., such as foam) may be coupled to or disposed against the front side 304 of the back portion 300.

A bottom 310 of the back portion 300 extends between the front side 304 and the back side 302, and includes one or more outwardly extending protrusions or teeth 312, 314. The teeth 312, 314 are configured to be received in the slots 218, 220 of the edge portion 206 of the seat portion 200 (as shown in FIG. 4). In one embodiment, the teeth 312, 314 have a plate-like configuration with inwardly angled edges 312*a*, 314*a*, as best shown in FIG. 12. The teeth 312, 314 aid in guiding the back portion 300 into proper alignment with the seat portion 200, and additionally aid in securing the seat portion 200 to the lower support portion 100, described in further detail below.

With continued reference to FIGS. 12 and 13, the right and left sides 306, 308 of the back portion 300 include flanges 316, 318, respectively. The flanges 316, 318 include openings 320, 322, respectively, which are positioned and configured to receive the guide posts 134, 136 of the braces 130, 132, respectively, when the back portion 300 is coupled to the lower support portion 100. Thus, the teeth 312, 314 of the back portion 300 ensure that the back portion 300 is properly aligned with the seat portion 200, and the guide posts 134, 136 ensure that the back portion 300 is properly aligned with the lower support portion 100.

First and second brackets 324, 326 extend downwardly from the bottom 310 of the back portion 300. In one implementation, the brackets 324, 326 extend downwardly from the bottom 310 adjacent opposite ends thereof. The brackets 324, 326 include apertures 328, 330, respectively. When the bottom 310 of the back portion 300 is properly seated on the lower support portion 100, the apertures 328, 330 in the brackets 324, 326 are aligned with and engageable by the distal ends 164*a*, 166*a* of the rods 164, 166 of the latch mechanism 160.

The lower support portion 100, seat portion 200 and/or back portion 300 may include one or more flexible layers and/or upholstery coverings secured thereto, as shown in FIG. 1. For example, each of the lower support portion 100, seat portion 200 and back portion 300 may include a decorative fabric covering secured thereto. As well known to those of skill in the art, the chair 10 may be upholstered using suitable synthetic and natural fabric covers. For example, the lower support portion 100 may include a fabric covering stapled or glued to the exteriorly disposed surfaces of the panels 140, 142, 144, 146. The seat portion 200 may include a fabric covering which is stretched over the raised surface 204 of the tray 202 (with foam or other cushioning material disposed therebetween), and secured thereto via staples or glue to an underside of the edge portion 206. Similarly, the back portion 300 may include a fabric covering which is stretched over and coupled to the front side 304, the back side 302 and the right and left sides 306, 308.

Figure 14:
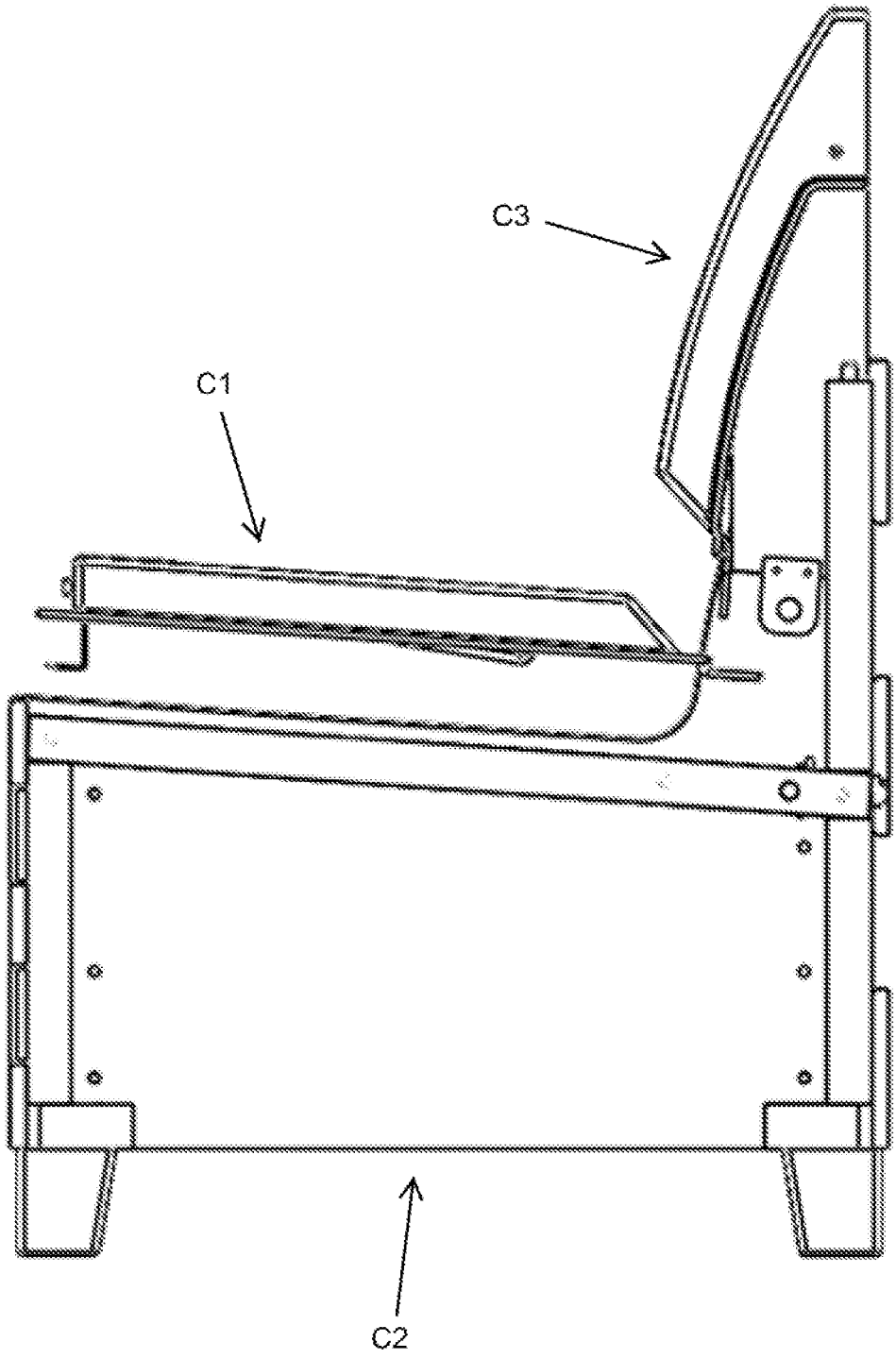
FIG. 14 illustrates a side elevational view showing the lower support portion, seat portion and back portion segments of the chair of FIG. 1 in a decoupled orientation.
Figure 15:
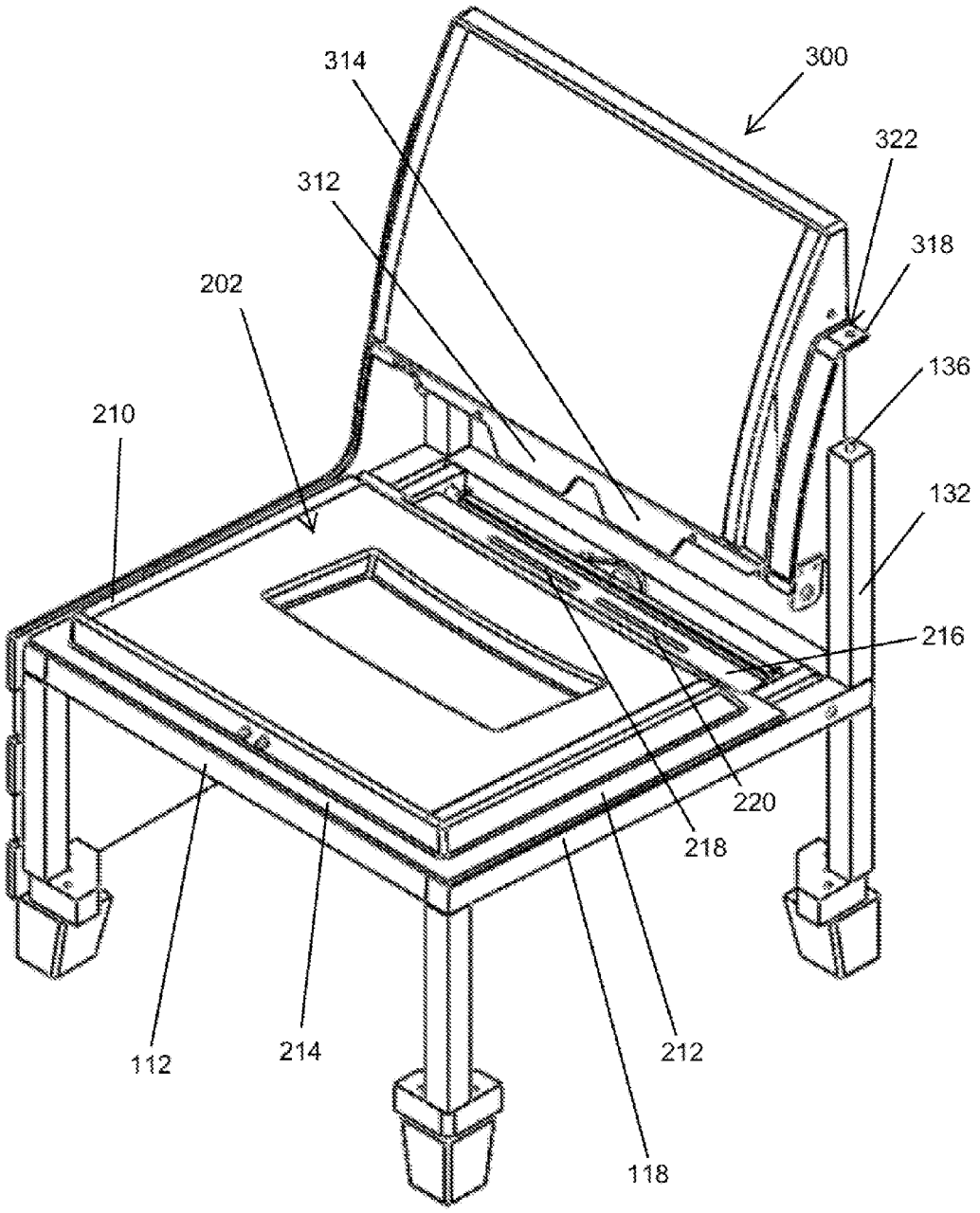
FIG. 15 illustrates a front perspective view of the seat portion coupled to the lower support portion and the back portion aligned with but decoupled from the lower support portion and seat portion.
Figure 16:
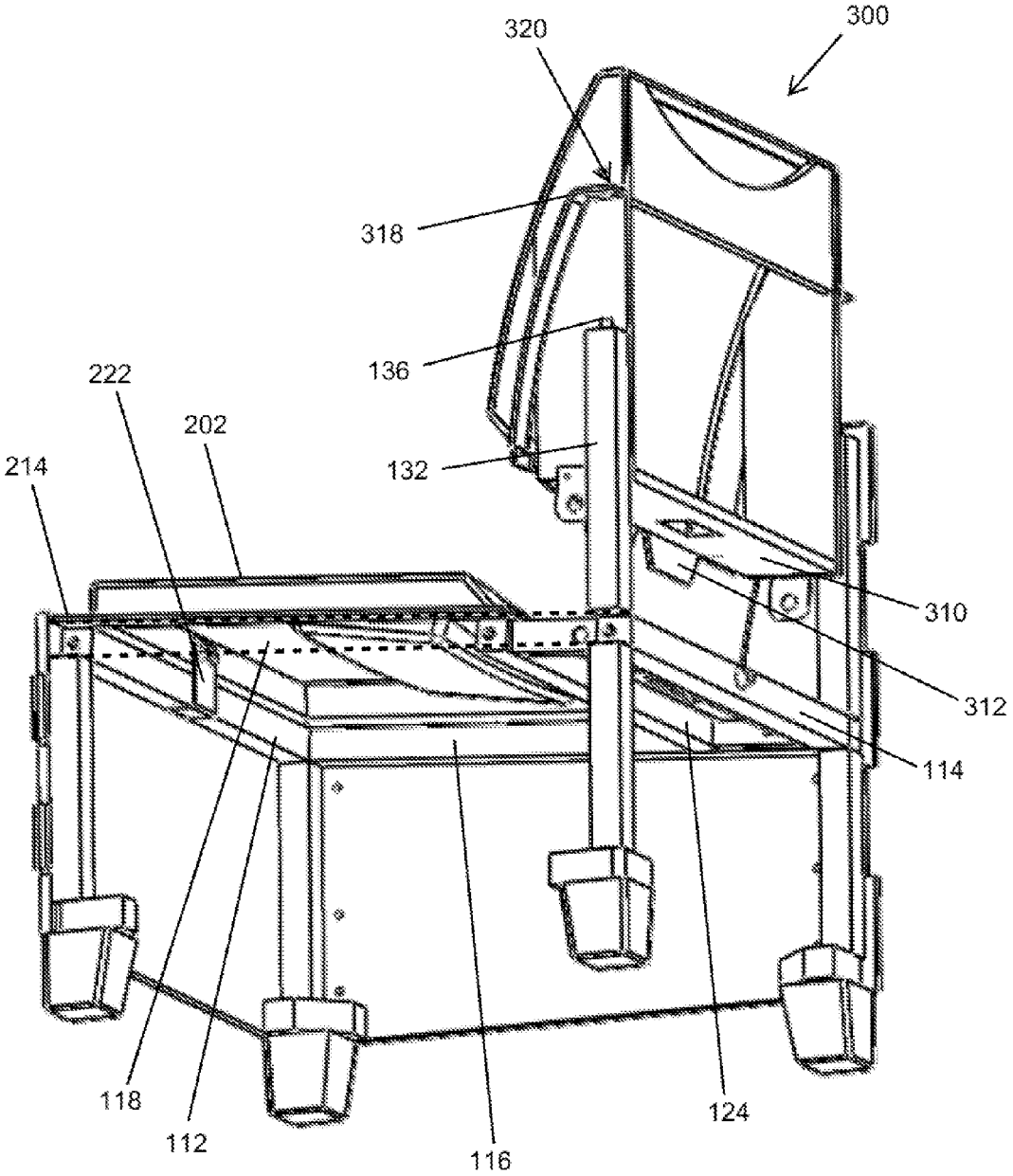
FIG. 16 illustrates a side perspective view of the components shown in FIG. 15, with portions shown in phantom.

Referring to FIGS. 1 and 14, the lower support portion 100, seat portion 200 and back portion 300 define three major sections or segments C1, C2, C3, respectively, of the chair 10 that may be readily assembled and disassembled, such as for storage, transport and/or re-covering. Referring to FIGS. 15 and 16, in order to assemble the segments C1, C2, C3, the tray 202 of the seat portion 200 is positioned on the cross bars 116, 118 of the lower support portion 100, so that the side areas 210, 212 of the edge portion 206 are aligned with the side cross bars 116, 118, respectively, and the front area 214 of the edge portion 206 is adjacent and aligned with the front cross bar 112. The tray 202 is then slid forward so that the retaining member 222 engages the front cross bar 112. The front cross bar 112 is thus disposed between the front area 214 of the edge portion 206 and the retaining member 222.

Figure 17:
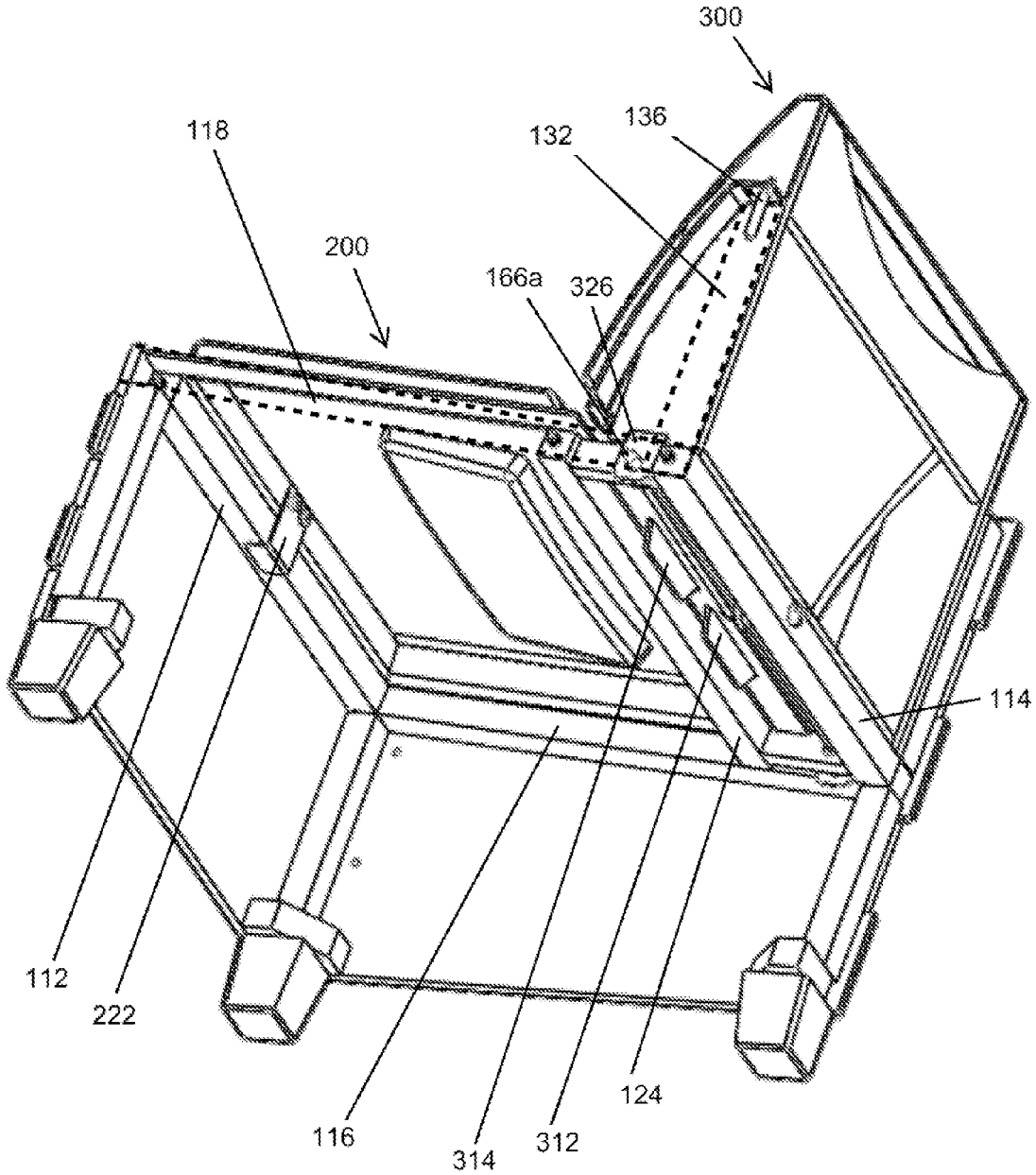
FIG. 17 illustrates a side perspective view of the seat portion coupled to the lower support portion and the back portion coupled to the lower support portion and seat portion, with portions shown in phantom.
Figure 18:
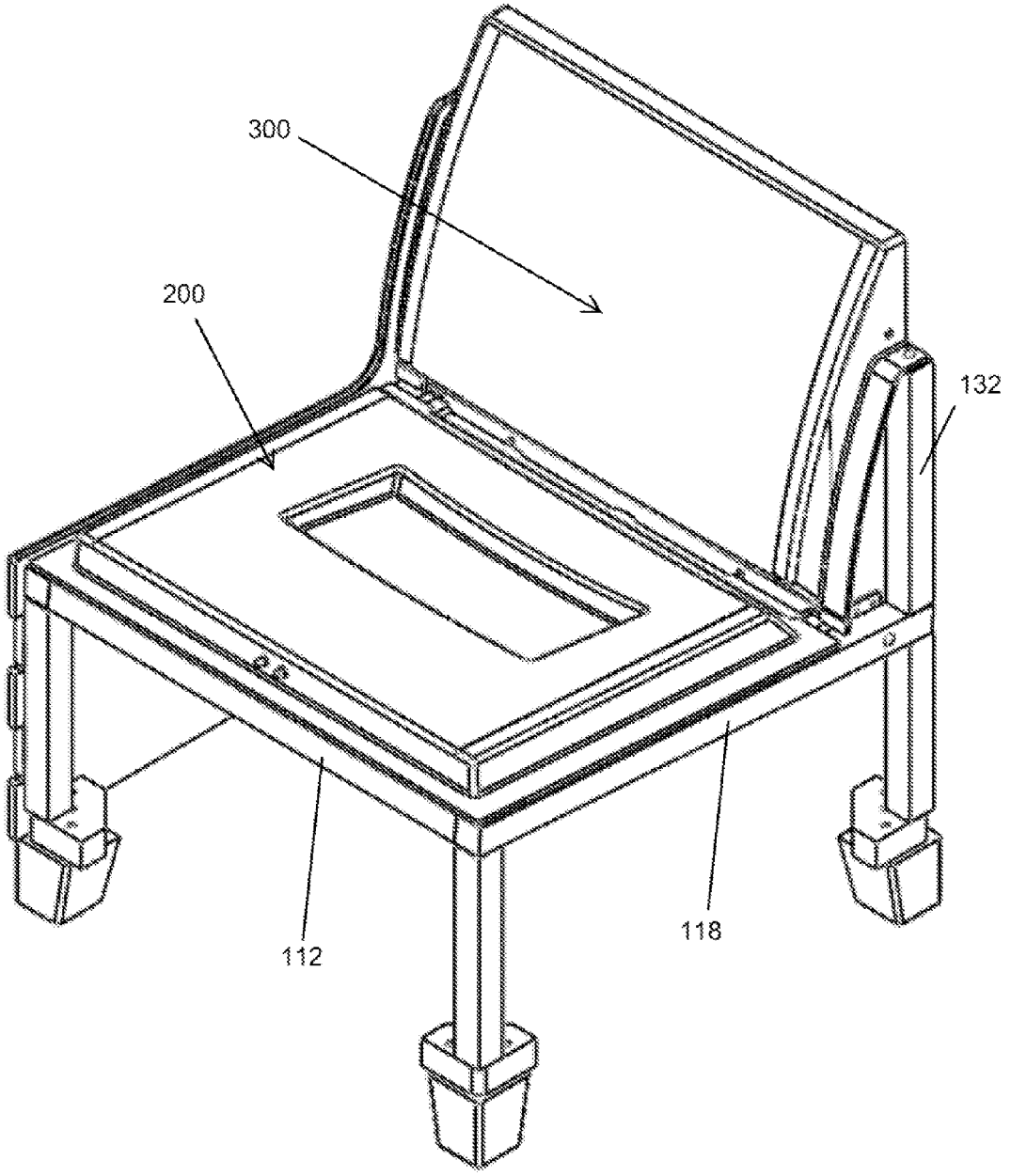
FIG. 18 illustrates a front perspective view of the lower support portion, the seat portion and the back portion coupled together, showing the chair of FIG. 1 without panels or coverings.

Next and with continued reference to FIGS. 15 and 16, the teeth 312, 314 of the back portion 300 are then aligned with and inserted into the slots 218, 220 in the back area 216 of the edge portion 206 of the tray 202 of the seat portion 200. If necessary, the back portion 300 is pivoted so that the openings 320, 322 in the flanges 316, 318 of the right and left sides 306, 308 of the back portion 300 are aligned with the guide posts 134, 136 on the first and second braces 130, 132. As the back portion 300 is pivoted into alignment with the guide posts 134, 136, a force is exerted on the tray 202, whereby the retaining member 222 on the tray 202 is slid or pushed toward and against the front cross bar 112. The tray 202 is thereby secured by the retaining member against the front cross bar 112 and the teeth 312, 314 of the back portion 300. The back portion 300 is then slid downwardly until the guide posts 134, 136 are received in the openings 320, 322 in the flanges 316, 318 of the back portion 300, respectively, and the bottom 310 of the back portion 300 is abutting the rear cross bar 114, as shown in FIGS. 17 and 18. In addition, the teeth 312, 314 are disposed within the slots 218, 220, so that the back portion 300 is seated against the seat portion 200.

Referring to FIGS. 8 and 17, when the back portion 300 is properly disposed on the lower support portion 100, the apertures 328, 330 in the brackets 324, 326 are aligned with the distal ends 164*a*, 166*a* of the rods 164, 166 of the latch mechanism 160, respectively. The distal ends 164*a*, 166*a* of the rods 164, 166 are moved from their unlocked position substantially flush with or recessed from the outer surfaces 126*a*, 128*a* of the spacer members 126, 128 to their locked position extending outwardly from the outer surfaces 126*a*, 128*a* of the spacer members 126, 128 and through the apertures 328, 330 in the corresponding brackets 324, 326. The rods 164, 166 are maintained in their locked position, so that the back portion 300 is secured between and by the rods 164, 166 and the guide posts 134, 136.

As shown in FIGS. 4 and 7, in one implementation, the plate 162 of the latch mechanism 160 is accessible through an opening or port 350 disposed in the rear panel 142 (and any covering such as upholster thereon), which is proximate to the rear cross bar 114. The plate 162 may include a keyhole or slot, which is configured to receive a corresponding key or bar. The key may be rotated by a user, which in turn rotates the plate, thereby actuating the latch mechanism 160 between its unlocked position and locked position. Alternatively, the plate 162 may include a flange or other protrusion extending outwardly therefrom and accessible by the user via the port 350. Rotation of the protrusion (e.g., such as with a wrench or other tool configured to engage the protrusion) causes pivotal movement of the plate 162, thereby causing actuation of the latch mechanism 160 between the unlocked position and the locked position.

Thus, actuation of the latch mechanism 160 may be implemented using various methods. However, the latch mechanism 160 is preferably easily moved between its unlocked and locked positions. In this way, the assembly of the lower support portion 100, seat portion 200 and back portion 300 is quickly and easily accomplished. In addition, the segments C1, C2, C3 of the chair 10 are preferably easily disassembled, such as for storage, transport, or to re-cover one or more of the segments. For disassembly, the latch mechanism 160 is moved from its locked position to its unlocked position. The back portion 300 may then be slid upwardly and away from the lower support portion 100. The teeth 312, 314 of the back portion 300 are thereby disengaged from the slots 218, 220 in the tray 202 of the seat portion 200. The retaining member 222 of the seat portion 200 may then be disengaged and slid away from the front cross bar 112, and removed from the lower support portion 100.

Figure 19:
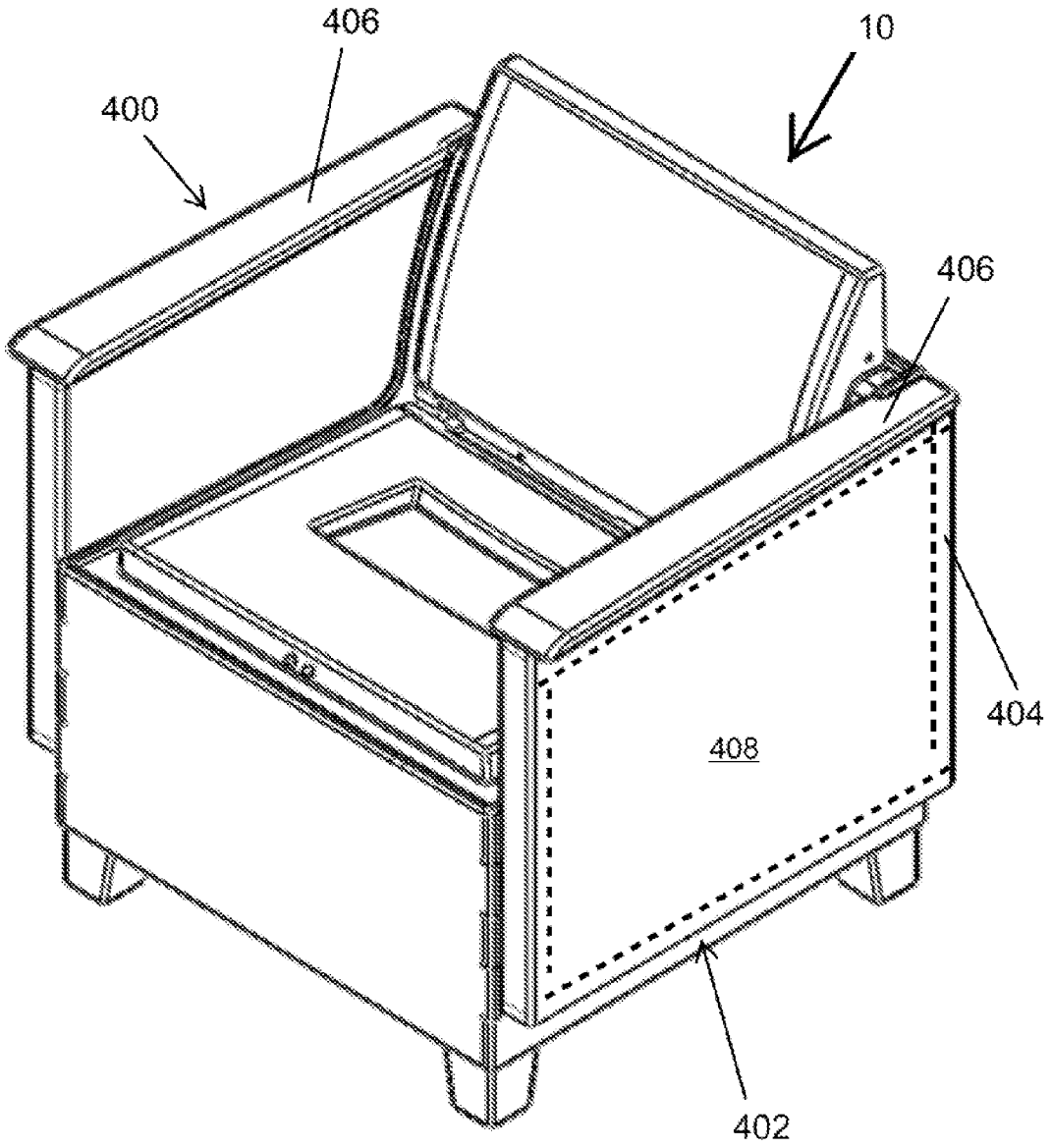
FIG. 19 illustrates a front perspective view of the chair of FIG. 1 without coverings on the lower support portion, seat portion or back portion, and including arm support members secured to the chair.

In one embodiment, right and left arm support members 400, 402 are coupled to the chair 10, as shown in FIG. 19. Each of the right and left arm support members 400, 402 includes an internal frame 404 (shown in phantom in the right arm support member 402), and an armrest 406 coupled thereto. A covering 408 (e.g., such as a fabric upholstery covering) may be secured to and encase the frame 404. The right and left arm support members 400, 402 are secured to opposing sides of the lower support portion 100 (e.g., such as via screws, adhesive or other fasteners).

In one implementation, the right and left arm support members 400, 402 are readily attachable and detachable from the lower support portion 100. In this way, the overall functionality and appearance of the chair 10 may be readily changed. For example, the chair 10 may be assembled without the arm support members 400, 402, as shown in FIG. 1, thereby providing a sleeker appearance and reducing the overall width of the chair 10. Alternatively, the chair 10 may include the arm support members 400, 402, as shown in FIG. 19, which may be appropriate in a lounge or living room setting. Alternatively, multiple chairs 10 may be coupled together to form a bench or seating unit, such as may be appropriate in an waiting room or office setting. For example, sides of the lower support portions 100 of two or more chairs 10 may be aligned and coupled together via bolts, screws or other fasteners. An arm support member 400 or 402 may be disposed between each pair of adjacently coupled chairs 10, thereby forming a row of attached chairs to form a couch-type unit.

The right and left arm support members 400, 402 may be detached from the lower support portion 100 and re-upholstered with new fabric. The color and pattern of the upholstery covering of the arm support members 400, 402 may be the same or different from coverings used on other segments C1, C2 or C3 of the chair 10. Because the segments C1, C2, C3 of the chair 10 (including the lower support portion 100, seat portion 200, back portion 300), as well as the right and left arm support members 400, 402 are easily disassembled from each other, a user may easily change the configuration of the chair 10 and/or recover one or more of the segments if damaged or worn out, or if the user desires to change the overall appearance of the chair 10. In this way, the style of the chair 10 may be readily altered by the user, and at a relatively low cost compared to the cost of repairing and/or re-covering a conventional chair.

While the invention has been described in connection with specific embodiments thereof, it will be understood that it is capable of further modifications and this application is intended to cover any variations, uses, or adaptations of the invention following, in general, the principles of the invention and including such departures from the present disclosure as come within known or customary practice within the art to which the invention pertains and as may be applied to the essential features hereinbefore set forth.

What is claimed is:

1. A modular chair comprising:

a support portion defining a receiving area, said support portion including a rear cross bar and an auxiliary cross bar spaced from said rear cross bar;

a seat portion removably disposable in said receiving area and supported by said support portion, said seat portion including a slot;

a back portion including an outwardly extending protrusion, said protrusion receivable in said slot; and a latch mechanism coupled to said support portion and actuatable between a locked position retaining said back portion against said support portion and an unlocked position permitting said back portion from being decoupled from said support portion, wherein, when said seat portion is disposed in said receiving area, said protrusion is disposable between said rear cross bar and said auxiliary cross bar and extendable through said slot so that said seat portion is retained within said receiving area when said latch mechanism is in said locked position.

2. The modular chair of claim 1, wherein said seat portion further comprises a retaining member engageable with a correspondingly configured component of said support portion when said seat portion is disposed in said receiving area.

3. The modular chair of claim 1, wherein said back portion further comprises an outwardly extending flange portion, said flange portion including a first alignment member, and said support portion further comprises an upwardly extending brace, said brace including a second alignment member engageable with said first alignment member when said back portion is retained against said support portion.

4. The modular chair of claim 1, further comprising left and right arm support members coupled to said support portion.

5. The modular chair of claim 1, wherein said seat portion includes a raised surface disposed on a first plane, and a peripheral edge portion extending around said raised surface and disposed on a second plane spaced from and substantially parallel to said first plane.

6. The modular chair of claim 5, wherein said slot is disposed in said peripheral edge portion.

7. A modular chair comprising:

a support portion defining a receiving area;

a seat portion removably disposable in said receiving area and supported by said support portion, said seat portion including a slot;

a back portion including an outwardly extending protrusion and first and second bracket members, said protrusion receivable in said slot; and a latch mechanism coupled to said support portion and actuatable between a locked position retaining said back portion against said support portion and an unlocked position permitting said back portion from being decoupled from said support portion, said latch mechanism comprising first and second rods having first ends coupled to a plate and second distal ends receivable in openings of said first and second bracket members, respectively, when said back portion is retained against said support portion and said latch mechanism is in said locked position, thereby retaining said back portion to said support portion, wherein, when said seat portion is disposed in said receiving area, said protrusion is extendable through said slot so that said seat portion is retained within said receiving area when said latch mechanism is in said locked position.

8. The modular chair of claim 7, wherein said latch mechanism is movable between said locked and unlocked positions via rotation of said plate.

9. The modular chair of claim 7, wherein said seat portion includes a raised surface disposed on a first plane, and a peripheral edge portion extending around said raised surface and disposed on a second plane spaced from and substantially parallel to said first plane.

10. The modular chair of claim 9, wherein said slot is disposed in said peripheral edge portion.

11. The modular chair of claim 7, wherein said seat portion further comprises a retaining member engageable with a correspondingly configured component of said support portion when said seat portion is disposed in said receiving area.

12. A modular chair comprising:

a support portion defining a receiving area;

a seat portion disposable in said receiving area and supported by said support portion, said seat portion including a slot;

a back portion including an outwardly extending protrusion and first and second bracket members extending outwardly from a bottom portion thereof, said protrusion extending outwardly from said bottom portion and disposed between said first and second bracket members, and said protrusion receivable in said slot; and a latch mechanism coupled to said support portion and actuatable between a locked position retaining said back portion against said support portion and an unlocked position permitting said back portion to be decoupled from said support portion, said latch mechanism including a catch configured to releasable engage at least one of said bracket members when in said locked position, thereby retaining said back portion to said support portion;

wherein, when said seat portion is disposed in said receiving area, said protrusion is extendable through said slot and said seat portion is retained within said receiving area when said latch mechanism is in said locked position.

13. The modular chair of claim 12, wherein said catch is configured as a rod having an end movable into and out of an opening in said at least one of said bracket members.

14. The modular chair of claim 12, wherein said seat portion further comprises a retaining member engageable with a correspondingly configured component of said support portion when said seat portion is disposed in said receiving area.

15. A modular chair comprising:

a support portion defining a receiving area;

a seat portion removably disposable in said receiving area and supported by said support portion;

a back portion including a bottom section removably disposable against said seat portion when said seat portion is disposed in said receiving area, and a bracket member extending outwardly from said bottom section; and a latch mechanism coupled to said support portion and actuatable between a locked position retaining said back portion to said support portion, and an unlocked position permitting said back portion from being decoupled from said support portion, said latch mechanism including a catch configured to releasably engage said bracket when said bottom section of said back portion is disposed against said seat portion and said seat portion is disposed in said receiving area, wherein said seat portion is retained within said receiving area and between said support portion and said back portion when said latch mechanism is in said locked position.

16. The modular chair of claim 15, wherein said seat portion further comprises a retaining member engageable with a correspondingly configured component of said support portion when said seat portion is disposed in said receiving area.

17. The modular chair of claim 15, wherein said catch is configured as a rod having an end movable into and out of an opening in said bracket member.

18. The modular chair of claim 15, wherein said support portion includes a port, said latch mechanism accessible and actuatable through said port.

19. The modular chair of claim 15, wherein said back portion further comprises a first alignment member, and said support portion further comprises a second alignment member engageable with said first alignment member when said back portion is retained against said support portion and disposed in a predetermined orientation relative to said support portion.

* * * * *

UNITED STATES PATENT AND TRADEMARK OFFICE

CERTIFICATE OF CORRECTION

PATENT NO. : 9,016,794 B2
APPLICATION NO. : 14/079680
DATED : April 28, 2015
INVENTOR(S) : Richard K. Ogg It is certified that error appears in the above-identified patent and that said Letters Patent is hereby corrected as shown below:

In the Claims

Column 10, line 32, in Claim 12, which reads in part "configured to releasable engage"

should read "configured to releasably engage"

Signed and Sealed this
Tenth Day of November, 2015

Michelle K. Lee

Michelle K. Lee
*Director of the United States Patent and Trademark Office*